United States Patent [19]

Nakamura et al.

[11] Patent Number: 4,611,574

[45] Date of Patent: Sep. 16, 1986

[54] PROTECTIVE GUARD FOR OIL BURNER

[75] Inventors: Kazuharu Nakamura, Nagoya; Yoshio Mito, Gifu; Kazuhiko Takeuchi, Nagoya, all of Japan

[73] Assignee: Toyotomi Kogyo Co., Ltd., Aichi, Japan

[21] Appl. No.: 693,925

[22] Filed: Jan. 23, 1985

[30] Foreign Application Priority Data

Jan. 24, 1984 [JP] Japan ..... 59-8568[U]

[51] Int. Cl.[4] ..... F23C 15/36

[52] U.S. Cl. ..... 126/201; 126/202

[58] Field of Search ..... 126/96, 202, 201

[56] References Cited

U.S. PATENT DOCUMENTS 1,332,474 3/1920 Skelly ..... 126/201

3,367,318 2/1968 Murakami et al. ..... 126/96

FOREIGN PATENT DOCUMENTS 3974 of 1909 United Kingdom ..... 126/202

*Primary Examiner*—Carroll B. Dority, Jr.

*Attorney, Agent, or Firm*—Pollock, Vande Sande & Priddy

[57] ABSTRACT

A protective guard for an oil burner is disclosed which is capable of compactly packing and storing an oil burner while having the protective guard attached thereto. The protective guard comprises a lower guard body fixedly mounted on the oil burner, an upper guard body fitted on the lower guard body and vertically moved with respect to the lower guard body, and a fixing means for releasably fixing the upper guard body to the lower guard body and allowing the upper guard body to be vertically moved with respect to the lower guard body and put on the lower guard body when the fixing means is released.

11 Claims, 8 Drawing Figures

PROTECTIVE GUARD FOR OIL BURNER

BACKGROUND OF THE INVENTION

1. Field of the Invention

This invention relates to a protective guard for an oil burner, and more particularly to such a protective guard which is adapted to be small-sized at the non-use, to thereby be compactly packed or stored while being mounted on an oil burner.

2. Description of the Prior Art

Conventionally, a protective guard for an oil burner has been used to cover a combustion section of the oil burner to protect a user from accidents occurring during the use of the oil burner. Accordingly, the protective guard is required to arranged at a position separate from the oil burner. However, this causes the protective guard to be significantly large-sized. Thus, the conventional protective guard has a disadvantage that because the packing or storing of an oil burner having the protective guard attached thereto is substantially bulky or oversized, it often requires the removal of the protective guard from the oil burner.

Accordingly, it would be highly desired to develop a protective guard for an oil burner which is capable of being small-sized at the non-use of the oil burner to allow the packing or storing of the oil burner to be carried out in a compact manner while having the protective guard attached thereto.

SUMMARY OF THE INVENTION

The present invention has been made in view of the foregoing disadvantage of the prior art.

In accordance with the present invention, there is provided a protective guard for an oil burner comprising a guard body arranged to surround a combustion section of an oil burner, said guard body comprising an upper guard body and a lower guard body which is adapted to be fixedly mounted with respect to said oil burner; and a fixing means provided between said upper guard body and said lower guard body to releasably fix said upper guard body to said lower guard body to form said protective guard and allow said upper guard body to be vertically moved with respect to said lower guard body in a nested manner and put on said lower guard body when said fixing means is released.

In accordance with the present invention, there is also provided a protective guard for an oil burner comprising a cylindrical guard body arranged to surround a combustion section of an oil burner, said guard body comprising a lower guard body for covering the lower portion of said combustion section of said oil burner which is fixedly mounted with respect to said combustion section and an upper guard body for covering the upper portion of said combustion section which is formed to have a diameter larger than said lower guard body so as to be fitted on said lower guard body and vertically moved with respect to said lower guard body and is closed at the upper end thereof; a fixing means provided between said upper guard body and said lower guard body to releasably fix said upper guard body to said lower guard body and allow said upper guard body to be vertically moved with respect to said lower guard body and put on said lower guard body when said fixing means is released; and a positioning means for facilitating the positioning and fixing between said upper guard body and said lower guard body when the fixing therebetween is to be carried out by said fixing means.

Further, in accordance with the present invention, there is provided a protective guard for an oil burner comprising a lower cylindrical guard body opened at both ends thereof for covering the lower portion of a combustion section of an oil burner and fixedly mounted with respect to said combustion section, said lower guard body comprising an annular inner support frame member and an inner cylindrical wire guard member securely mounted at said inner support frame member to downward extend therefrom; an upper cylindrical guard body for covering the upper portion of said combustion section, said upper guard body comprising an annular outer support frame member having a diameter larger than said lower guard body and an outer cylindrical wire guard member securely supported on said outer support frame member and closed at the upper end thereof and opened at the lower end thereof so that said upper guard body may be vertically moved with respect to said lower guard body in a manner to be fitted thereon; a fixing means adapted to releasably fix said upper guard body to said lower guard body to form said protective guard and allow said upper guard body to be vertically moved with respect to said lower guard body and put on said lower guard body when said fixing means is released, said fixing means comprising downward extending projections respectively provided at said outer support frame member and said inner support frame member so as to positionally correspond to one another and screws for securely connecting said positionally corresponding projections together to fix said upper guard body to said lower guard body; and a positioning means for facilitating the positioning and fixing between said upper guard body and said lower guard body when the fixing therebetween is to be carried out by said fixing means, said positioning means comprising at least one inward flange provided at the inner surface of said outer support frame member and a shoulder formed at the outer surface of said inner support frame member which are adapted to be engaged with each other at a position where said upper guard body is to be fixed to said lower guard body.

Furthermore, in accordance with the present invention, there is provided a protective guard for an oil burner comprising a lower cylindrical guard body opened at both ends thereof for covering the lower portion of a combustion section of an oil burner and fixedly mounted with respect to said combustion section, said lower guard body comprising an annular inner support frame member and an inner cylindrical wire guard member securely mounted at said inner support frame member to downward extend therefrom; an upper cylindrical guard body for covering the upper portion of said combustion section, said upper guard body comprising an annular outer support frame member having a diameter larger than said lower guard body and an outer cylindrical wire guard member securely supported on said outer support frame member and closed at the upper end thereof and opened at the lower end thereof so that said upper guard body may be vertically moved with respect to said lower guard body in a manner to be fitted thereon; a fixing means adapted to releasably fix said upper guard body to said lower guard body to form said protective guard and allow said upper guard body to be vertically moved with respect to said lower guard body and put on said lower guard body when said fixing means is released, said fixing means comprising downward extending projections respectively provided at said outer support frame member and said inner support frame member so as to positionally correspond to one another and screws for securely connecting said positionally corresponding projections together to fix said upper guard body to said lower guard body; and a positioning means for facilitating the positioning and fixing between said upper guard body and said lower guard body when the fixing therebetween is to be carried out by said fixing means, said positioning means comprising at least one projection provided at the inner surface of said outer support frame member and a cutout formed at the outer surface of said inner support frame member which are adapted to be engaged with each other at a position where said upper guard body is to be fixed to said lower guard body.

Accordingly, it is an object of the present invention to provide a protective guard for an oil burner which is capable of being small-sized at the non-use of the oil burner to allow the oil burner to be compactly packed or stored while having the protective guard attached thereto.

It is another object of the present invention to provide a protective guard for an oil burner which is capable of being readily small-sized with a simple operation.

It is a further object of the present invention to provide a protective guard for an oil burner which is capable of being small-sized at the non-use of the oil burner to allow the packing or storing of the oil burner having the protective guard attached thereto to be compactly carried out while effectively exhibiting the protecting function at the use of the oil burner.

It is still a further object of the present invention to provide a protective guard for an oil burner which is capable of being readily expanded to effectively exhibit the protective function when the oil burner is to be used.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout, wherein.

DETAILED DESCRIPTION OF THE PREFERRED EMBODIMENTS

Now, a protective guard for an oil burner according to the present invention will be described hereinafter with reference to the accompanying drawings.

Figure 1:
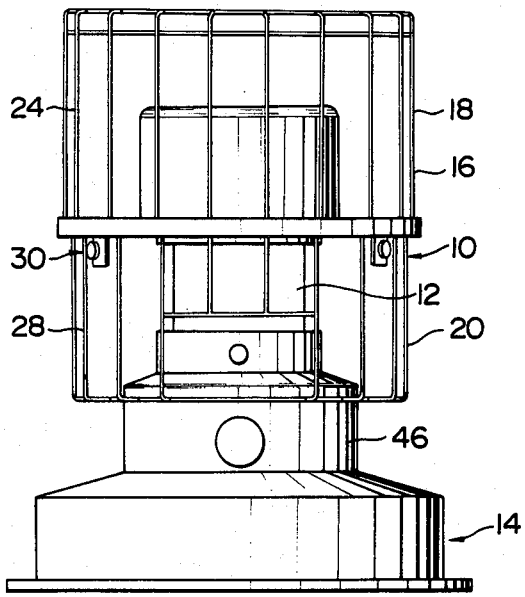
FIG. 1 is a front elevation showing one embodiment of a protective guard for an oil burner according to the present invention which is put on an oil-fires space heater for the use.

FIG. 1 shows one embodiment of a protective guard for an oil burner according to the present invention. A protective guard of the illustrated embodiment is generally designated by reference numeral 10 and is securely covered on an oil-fired space heater of the radiation type which is generally formed into a cylindrical shape. However, it should be understood that a protective guard according to the present invention is applicable to an oil burner other than such a space heater as shown in FIG. 1.

The protective guard 10 of the illustrated embodiment is adapted to cover a combustion section 12 of an oil burner 14 and comprises a guard body 16 which comprises an upper guard body 18 adapted to cover the upper portion of the combustion section 12 and a lower guide body 20 adapted to cover the lower portion of the combustion section 12. The upper guard body 18 comprises an annular outer support frame member 22 formed by, for example, bending a metal sheet and an outer wire guard member 24 of a cylindrical shape supported on the support frame member 22 and opened at the lower end. In the embodiment illustrated, the outer wire guard member 24 is formed of a metal wire and closed at the upper end thereof and opened at the lower end thereof. The lower guard body 20 comprises an annular inner support frame 26 formed by, for example, bending a metal sheet and an inner wire guard member 28 of a cylindrical shape supported by the frame 26 and formed to be opened at the upper and lower ends thereof. The inner support frame 26 is formed to have a diameter smaller than that of the outer support frame member 22 to allow the lower guard body 20 to be movably fitted in the upper guard body 18. In the illustrated embodiment, the inner wire guard member 28 is formed of metal. The upper guard body 18 and the lower guard body 20 are connected together through the support frame members 22 and 26 in a manner as described hereinafter.

Figure 2:
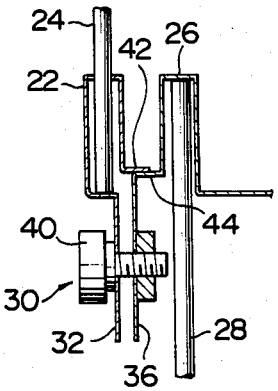
FIG. 2 is a fragmentary vertical sectional view showing the fixed connection between an upper guard body and a lower guard body in the protective guard shown in FIG. 1.

The protective guard 10 also comprises a clamping or fixing means 30 which are provided at the connection between the upper guard member 18 and the lower guard member 20 to releasably securely connecting the upper frame body 18 to the lower frame body 20. More particularly, in the illustrated embodiment, the fixing means 30, as shown in FIGS. 1 and 2, comprises at least two downward extending elements 32 circumferentially provided on the outer support frame member 22 of the upper guard body 18 in a manner to be spaced at a suitable interval from each other and each formed with a through-hole 34, at least two downward extending elements 36 circumferentially provided on the inner support frame member 26 of the lower guard body 20 to positionally correspond to the elements 32 of the outer support frame member 22 and each formed with a through-hole 38, and screws 40 inserted through the through-holes 34 and 38 of the elements 32 and 34 to fixedly engage the elements together, to thereby securely connect the upper and lower guard bodies together.

Figure 3:
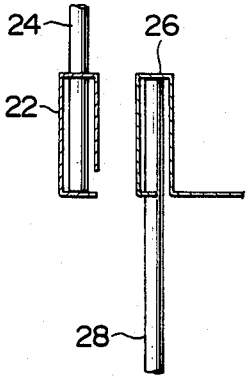
FIG. 3 is a fragmentary vertical sectional view showing the positional relationship between an upper guard body and a lower guard body in the protective guard of FIG. 1 except the connection therebetween.

In the illustrated embodiment, the outer support frame member 22 is formed at the lower portion of the inner surface thereof with inward extending flanges 42 and correspondingly the inner support frame member 26 is formed at the lower portion of the outer surface thereof with shoulders 44 through which the downward extending element 32 is provided at the inner support frame member 26. Such construction facilitates the engagement and positioning between the outer support frame member 22 and the inner support frame member 26 to readily carry out the secure connection therebetween. The outer and inner support frame members 22 and 26 are separated from each other at the portions other than those provided with the flanges 42 and shoulders 44, as shown in FIG. 3.

The lower guard body 20 is fixedly mounted to a frame 46 (FIG. 1) of the combustion section 12 of the oil burner 14 in such a manner as known in the art by means of a suitable means.

Now, the manner of operation of the protective guard 10 of the illustrated embodiment constructed as described above will be described with reference to the drawings.

Figure 5:
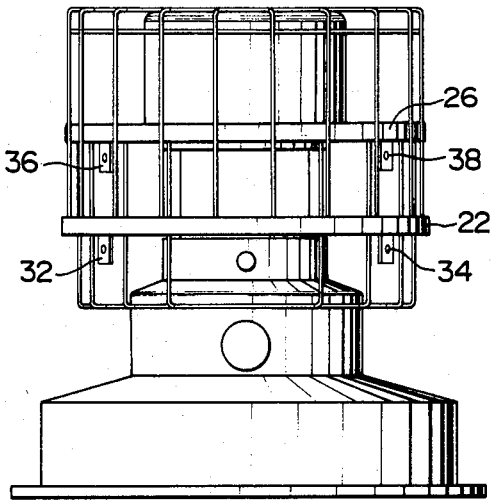
FIG. 5 is a front elevation showing the protective guard of FIG. 1 which has been small-sized for packing or storing the oil burner while having the protective guard attached thereto.

FIG. 1 shows a state that the protective guard is assembled or used, and FIG. 5 shows a state that the guard is not used or small-sized. The deformation of the guard 10 from the state shown in FIG. 1 to that of FIG. 5 will be carried out as follows.

Figure 4:
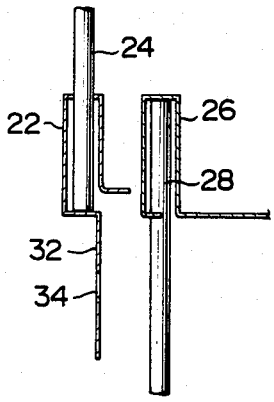
FIG. 4 is a fragmentary vertical sectional view showing the positional relationship between an upper guard body and a lower guard body in the protective guard of FIG. 1 after removing screws of a fixing means and prior to overlapping the upper guard body on the lower guard body.
Figure 6:
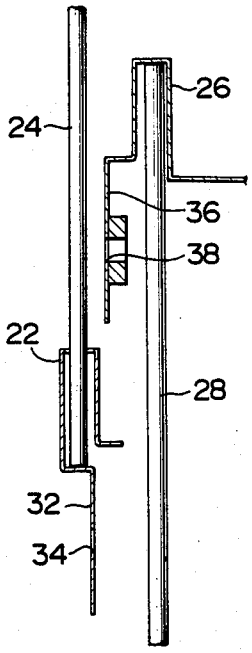
FIG. 6 is a fragmentary vertical sectional view showing the positional relationship of a fixing means in the protective guard of FIG. 1 after it is small-sized, wherein the upper guard body and lower guard body are sectioned on planes different from each other.

First, the screws 40 of the fixing means 30 are removed from the downward extending elements 32 and 36, and then the upper guard body 18 is rotatedly moved with respect to the lower guard body 20 to release the engagement between the flanges 42 and the shoulders 44, as shown in FIG. 4. This results in the upper guard body 18 being free from the lower guard body 20. Then, the upper guard body 18 is downward moved until the upper end thereof abuts against the upper surface of the combustion section 12 of the oil burner 14, so that the upper end of the protective guard 10 may be on the substantially same level as the oil burner, as shown in FIG. 5. The vertical positional relationship of the fixing means 30 is shown in FIG. 6.

The deformation from FIG. 5 to FIG. 1 is carried out in reverse order. More particularly, the upper guard body 18 put on the upper surface of the combustion section 12 is first upward moved and then rotated with respect to the lower guard body 20 to vertically align the flanges 42 and shoulders 44 with one another. Then, the flanges 42 are rested on the shoulders 44 to align the through-holes 34 and 38 with each other and further the screws are inserted to securely connect the upper and lower guard bodies 18 and 20 together in a manner as shown in FIG. 1.

Figure 7:
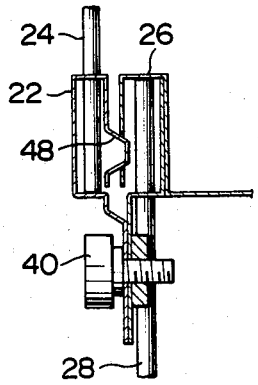
FIG. 7 is a fragmentary vertical sectional view showing the essential part of another embodiment of a protective guard for an oil burner according to the present invention.
Figure 8:
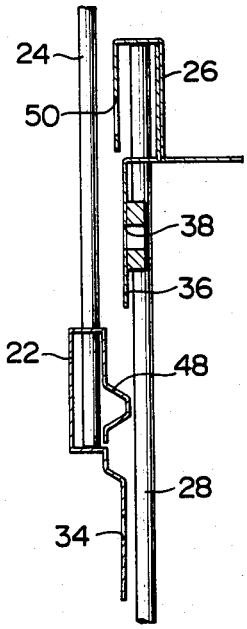
FIG. 8 is a fragmentary vertical sectional view showing the state that an upper guard member is released from a lower guard member in the protective guard shown in FIG. 5.

FIG. 7 shows the essential part of another embodiment of a protective guard for an oil burner according to the present invention. In the embodiment shown in FIG. 7, a positioning means for facilitating the engagement and positioning between an upper guard body 18 and a lower guard body 20 is constructed in a manner different from that in the above-described embodiment. More particularly, in the embodiment of FIG. 7, an outer support frame member 22 is integrally provided at the inner side thereof with elastic projections 48 formed by expanding a metal sheet and correspondingly the inner support frame member 26 is formed at the outer side thereof with cutouts 50. The disengagement of the elastic projections 48 from the cutouts 50 is carried out by rotating the upper guard body 18 with respect to the lower guard body 20. The remaining part of the embodiment shown in FIG. 7 is constructed in the substantially same manner as that of FIG. 1.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, as a matter of language, might be said to fall therebetween.

What is claimed is:

1. A protective guard for an oil burner comprising:

a guard body arranged to surround a combustion section of an oil burner, said guard body comprising an upper guard body and a lower guard body which is adapted to be fixedly mounted with respect to said oil burner, and said upper guard body being formed to be fitted on said lower guard body and closed at the upper end thereof; and a. fixing means provided between said upper guard body and said lower guard body to releasably fix said upper guard body to said lower guard body to constitute said protective guard and allow said upper guard body to be vertically moved with respect to said lower guard body in a nested manner and put on said lower guard body when said fixing means is released.

2. A protective guard as defined in claim 1, wherein said upper and lower guard bodies each are formed into a cylindrical shape.

3. A protective guard as defined in claim 2, wherein said upper guard body comprises as annular outer support frame member and an outer cylindrical wire guard member securely supported on said outer support frame member and said lower guard body comprises and annular inner support frame member and an inner cylindrical wire guard member securely mounted at said inner support frame member to downward extend therefrom.

4. A protective guard as defined in claim 3, wherein said fixing means comprises downward extending projections respectively provided at said outer support frame member and said inner support frame member so as to positionally correspond to one another and screws for securely connecting said projection together.

5. A protective guard as defined in claim 1 further comprising a positioning means for facilitating the positioning and fixing between said upper guard body and said lower guard body when the fixing therebetween is to be carried out by said fixing means.

6. A protective guard as defined in claim 4 further comprising a positioning means for facilitating the positioning and connecting between said upper guard body and said lower guard body.

7. A protective guard as defined in claim 6, wherein said positioning means comprises at least one inward extending flange provided at the inner surface of said outer support frame member and a shoulder formed at the outer surface of said inner support frame member which are engaged with each other at a position where said upper guard body is to be fixed to said lower guard body.

8. A protective guard as defined in claim 6, wherein said positioning means comprising at least one projection provided at the inside of said outer support frame member and a cutout formed at the outside of said inner support frame member to be engaged with said projection at a position where said upper guard body is to be fixed to said lower guard body.

9. A protective guard for an oil burner comprising:

a cylindrical guard body arranged to surround a combustion section of an oil burner, said guard body comprising a lower guard body for covering the lower portion of said combustion section of said oil burner which is fixedly mounted with respect to said combustion section and an upper guard body for covering the upper portion of said combustion section which is formed to have a diameter larger than said lower guard body so as to be fitted on said lower guard body and vertically moved with respect to said lower guard body and is closed at the upper end thereof;

a fixing means provided between said upper guard body and said lower guard body to releasably fix said upper guard body to said lower guard body and allow said upper guard body to be vertically moved with respect to said lower guard body and put on said lower guard body when said fixing means is released; and a positioning means for facilitating the positioning and fixing between said upper guard body and said lower guard body when the fixing therebetween is to be carried out by said fixing means.

10. A protective guard for an oil burner comprising:

a lower cylindrical guard body opened at both ends thereof for covering the lower portion of a combustion section of an oil burner and fixedly mounted with respect to said combustion section, said lower guard body comprising an annular inner support frame member and an inner cylindrical wire guard member securely mounted at said inner support frame member to downward extend therefrom;

an upper cylindrical guard body for covering the upper portion of said combustion section, said upper guard body comprising an annular outer support frame member having a diameter larger than said lower guard body and an outer cylindrical wire guard member securely supported on said outer support frame member and closed at the upper end thereof and opened at the lower end thereof so that said upper guard body may be vertically moved with respect to said lower guard body in a manner to be fitted thereon;

a fixing means adapted to releasably fix said upper guard body to said lower guard body to constitute said protective guard and allow said upper guard body to be vertically moved with respect to said lower guard body and put on said lower guard body when said fixing means is released, said fixing means comprising downward extending projections respectively provided at said outer support frame member and said inner support frame member so as to positionally correspond to one another and screws for securely connecting said positionally corresponding projections together to fix said upper guard body to said lower guard body; and a positioning means for facilitating the positioning and fixing between said upper guard body and said lower guard body when the fixing therebetween is to be carried out by said fixing means, said positioning means comprising at least one inward flange provided at the inner surface of said outer support frame member and a shoulder formed at the outer surface of said inner support frame member which are adapted to be engaged with each other at a position where said upper guard body is to be fixed to said lower guard body.

11. A protective guard for an oil burner comprising:

a lower cylindrical guard body opened at both ends thereof for covering the lower portion of a combustion section of an oil burner and fixedly mounted with respect to said combustion section, said lower guard body comprising an annular inner support frame member and in inner cylindrical wire guard member securely mounted at said inner support frame member to downward extend therefrom;

an upper cylindrical guard body for covering the upper portion of said combustion section, said upper guard body comprising an annular outer support frame member having a diameter larger than said lower guard body and an outer cylindrical wire guard member securely supported on said outer support frame member and closed at the upper end thereof and opened at the lower end thereof so that said upper guard body may be vertically moved with respect to said lower guard body in a manner to be fitted thereon;

a fixing means adapted to releasably fix said upper guard body to said lower guard body to constitute said protective guard and allow said upper guard body to be vertically moved with respect to said lower guard body and put on said lower guard body when said fixing means is released, said fixing means comprising downward extending projections respectively provided at said outer support frame member and said inner support frame member so as to positionally correspond to one another and screws for securely connecting said positionally corresponding projections together to fix said upper guard body to said lower guard body; and a positioning means for facilitating the positioning and fixing between said upper guard body and said lower guard body when the fixing therebetween is to be carried out by said fixing means, said positioning means comprising at least one projection provided at the inner surface of said outer support frame member and a cutout correspondingly formed at the outer surface of said inner support frame member which are adapted to be engaged with each other at a position where said upper guard body is to be fixed to said lower guard body.

* * * * *